US007605678B2

(12) United States Patent
Ando et al.

(10) Patent No.: US 7,605,678 B2
(45) Date of Patent: Oct. 20, 2009

(54) MULTIPLE-MODE DIELECTRIC RESONATOR, DIELECTRIC FILTER, AND COMMUNICATION DEVICE

(75) Inventors: Masamichi Ando, Kyoto (JP); Takaya Wada, Kyoto (JP); Kunihiro Komaki, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 12/274,883

(22) Filed: Nov. 20, 2008

(65) Prior Publication Data

US 2009/0072929 A1 Mar. 19, 2009

Related U.S. Application Data

(62) Division of application No. 10/584,843, filed as application No. PCT/JP2004/016998 on Nov. 16, 2004, now abandoned.

(30) Foreign Application Priority Data

Jan. 13, 2004 (JP) ..... 2004-005341

(51) Int. Cl.
*H01P 1/20* (2006.01)
*H01P 7/10* (2006.01)

(52) U.S. Cl. ..... 333/219.1; 333/202

(58) Field of Classification Search ..... 333/202, 333/219.1, 219, 208, 209, 212, 206
See application file for complete search history.

(56) References Cited

U.S. PATENT DOCUMENTS

| | | | | |
|---|---|---|---|---|
| 4,138,652 | A | 2/1979 | Nishikawa et al. | |
| 5,034,711 | A * | 7/1991 | Hendrick et al. | 333/219.1 |
| 5,059,929 | A | 10/1991 | Tanaka | |
| 6,496,087 | B1 | 12/2002 | Hattori et al. | |
| 2004/0178664 | A1 | 9/2004 | Hyuga | |
| 2004/0257176 | A1 | 12/2004 | Pance et al. | |

FOREIGN PATENT DOCUMENTS

| | | |
|---|---|---|
| JP | 51-014373 | 2/1976 |
| JP | 58-207701 | 12/1983 |
| JP | 2-168705 | 6/1990 |
| JP | 5-129813 | 5/1993 |
| JP | 51-49940 | 6/1993 |
| JP | 11-145705 | 5/1999 |
| JP | 2001-060804 | 3/2001 |
| JP | 2001-060805 | 3/2001 |
| JP | 2002-016410 | 1/2002 |

* cited by examiner

*Primary Examiner*—Stephen E Jones
(74) *Attorney, Agent, or Firm*—Dickstein Shapiro LLP

(57) ABSTRACT

A multiple-mode dielectric resonator in which a through hole is formed in a substantially cubic dielectric core so as to pass through opposing surfaces thereof. A conductive support bar is inserted into the through hole. Both ends of the support bar are secured to a cavity, and opposing inside walls defining the cavity are electrically connected to each other (are short-circuited) by the support bar. Therefore, the dielectric core is disposed in the cavity without using a support base, so that the resonance frequencies of TM01 delta modes, which are spurious modes, are considerably separated from frequencies of TE01 delta modes that are used.

18 Claims, 11 Drawing Sheets

MULTIPLE-MODE DIELECTRIC RESONATOR, DIELECTRIC FILTER, AND COMMUNICATION DEVICE

CROSS REFERENCE TO RELATED APPLICATIONS

The present application is a divisional of application Ser. No. 10/584,843, filed Jun. 28, 2006 now abandoned, which is a National Stage of International Application No. PCT/JP2004/016998, filed Nov. 16, 2004, which claims priority to Japanese Patent Application No. JP2004-005341, filed Jan. 13, 2004, the entire contents of each of these applications being incorporated herein by reference in their entirety.

FIELD OF THE INVENTION

The present invention relates to a dielectric resonator which operates in multiple modes, a dielectric filter, and a communication device including the dielectric resonator and the dielectric filter.

BACKGROUND OF THE INVENTION

Multiple-mode dielectric resonators in which a dielectric core is disposed in a conductive cavity and in which a plurality of TE01 delta modes are subjected to multiplexing are known. In these dielectric resonators, such as those disclosed in the Patent Documents 1 and 2, a substantially cubic dielectric block is disposed in a substantially cubic cavity, and TE01 delta modes in which electric field vectors pass around three axes that are perpendicular to each other are subjected to triplexing.

Patent Document 1: Japanese Unexamined Patent Application Publication No. 2001-60804

Patent Document 2: Japanese Unexamined Patent Application Publication No. 2001-60805

An example of a structure of a related multiple-mode dielectric resonator using a support base and examples of resonance modes that are set in the multiple-mode dielectric resonator are shown in FIGS. 17(A) and 17(B). In FIGS. 17(A) and 17(B), a support base 40 is formed of a dielectric member, and a dielectric core 1 is disposed in a central portion of a cavity 2 by supporting the dielectric core 1 in the cavity 2. In FIG. 17(A), electric field vectors of three TE01 delta modes (represented by a cylindrical coordinate system) are indicated by arrows. In FIG. 17(B), electric field vectors of three TM01 delta modes (represented by a cylindrical coordinate system) are similarly indicated by arrows.

However, in the related multiple-mode dielectric resonator, when an attempt is made to use the aforementioned three TE01 delta modes, the resonance modes of the three TM01 delta modes are set as spurious modes. The influences of the spurious modes (that is, the response of the spurious modes) give rise to the problem that proper attenuation characteristics cannot be obtained when the dielectric resonator is used as a filter.

To efficiently use the TE01 delta modes, it is necessary to secure the substantially cubic dielectric core so that it is raised. Accordingly, in the related art, as shown in FIGS. 17(A) and 17(B), the dielectric core 1 is adhered to the support base 40, formed of ceramic having a low dielectric constant, and the support base 40 is secured to the bottom surface in the cavity 2.

To adhere the dielectric core and the support base together with an adhesive, it is necessary to polish both the support base and the dielectric core and smooth an adhesion surface, resulting in increased costs. In addition, in general, long-term reliability of an adhesive is low. As a result, when the adhesive is placed in a high-temperature high-humidity environment for a long period of time and receives a strong impact, the dielectric core tends to separate from the support base.

SUMMARY OF THE INVENTION

According, it is an object of the invention to provide a multiple-mode dielectric resonator which can overcome the problem caused by the influences of the spurious modes and the problem regarding the reliability of the structure of supporting the dielectric core through the support base, to provide a dielectric filter including the dielectric resonator, and to provide a communication device including the dielectric resonator and the dielectric filter.

According to an aspect of the present invention, a multiple-mode dielectric resonator comprises a dielectric core that is disposed in a conductive cavity so as to be separated by a predetermined distance from a surface of at least one inside wall defining the cavity. In the dielectric resonator, a through hole is formed in the dielectric core, and at least one support bar is inserted into the through hole and is secured to the cavity, so that the dielectric core is supported in the cavity.

According to another aspect, the at least one support bar is conductive, and both ends of the at least one support bar are electrically connected to opposing inside walls of the at least one inside wall defining the cavity, so that a short circuit is produced between the inside walls defining the cavity.

According to another aspect, an insulating bushing is disposed between an inside wall defining the through hole in the dielectric core and the at least one support bar.

According to another aspect, the bushing is formed of a material whose dielectric constant is lower than that of the dielectric core.

According to another aspect, the cavity has a rectangular parallelepiped form, the at least one support bar comprises two or three support bars, and both ends of each support bar are joined to different pairs of opposing inside walls of the at least one inside wall defining the cavity.

According to another aspect, the dielectric core has a substantially rectangular parallelepiped form.

According to another aspect, at least a portion of the at least one support bar is formed of a material whose dielectric constant is lower than that of the dielectric core.

According to another aspect, the at least one support bar has a hollow and is formed of a material whose dielectric constant is lower than that of the dielectric core, and a conductor is disposed in the hollow.

According to another aspect, the through hole and the at least one support bar each have a polygonal form in cross section.

According to another aspect, any one of the above-described the multiple-mode dielectric resonators is a resonator in which excitation occurs at three TE01 delta modes in which electric field vectors, respectively, pass around three coordinate axes that are orthogonal to each other.

According to another aspect, a dielectric filter comprises any one of the above-described multiple-mode dielectric resonators, and external coupling means for externally coupling to a predetermined mode of the multiple-mode dielectric resonator.

According to another aspect, a communication device is such that any one of the above-described multiple-mode dielectric resonators or the above-described dielectric filter is provided at a high-frequency circuit.

According to this invention, by forming a through hole in the dielectric core, inserting the at least one support bar into the through hole, and securing the at least one support bar to the cavity, the dielectric core can be supported in the cavity without using a support base, such as a ceramic substrate. Therefore, it is possible to circumvent the problem of the reliability of the supporting structure being reduced due to the use of an adhesive.

In addition, it is possible to circumvent the problem of the frequencies of TM01 delta modes, which are spurious modes when TE01 delta modes are used, being situated close to the TE01 delta modes. That is, since a dielectric support base is not used, it is possible to prevent a reduction in, in particular, the resonance frequencies of the TM01 delta modes in which electric field vectors face the thickness direction of the support base and to move away the frequencies of the TM01 delta modes up to a frequency which does not influence the resonance frequencies of the TE01 delta modes that is used.

Since the at least one support bar is conductive and both ends of the at least one support bar are electrically connected to opposing inside walls of the at least one inside wall defining the cavity, the resonance frequencies of the TM modes (that is, the TM01 delta modes represented by a cylindrical coordinate system) in which electric field vectors are oriented between the opposing inside walls defining the cavity are considerably higher than a frequency that is used.

By disposing an insulating bushing between the at least one support bar and an inside wall of the through hole formed in the dielectric core, it is possible to prevent a reduction in Q caused by a conductor directly contacting the dielectric core.

By forming the bushing using a material whose dielectric constant is lower than that of the dielectric core, it is possible to make the bushing more effective.

By forming the cavity with a rectangular parallelepiped form, and adhering both ends of two or three support bars to different pairs of opposing inside walls of the at least one inside wall defining the cavity, it is possible to strengthen the structure of mechanically supporting the dielectric core in the cavity. Therefore, it is possible to restrict variations in characteristics with respect to vibration and shock.

By forming the dielectric core with a substantially rectangular parallelepiped form, the dielectric core having the aforementioned through hole can be easily produced.

By forming at least a portion of the at least one support bar using a material whose dielectric constant is lower than that of the dielectric core, it is possible to restrict a reduction in Q of the resonator.

The at least one support bar is formed of a material whose dielectric constant is lower than that of the dielectric core, and a conductor is disposed in the hollow inner portion of the at least one support bar, so that the dielectric core is supported at the dielectric portion of the at least one support bar. Therefore, a reduction in Q of the resonator can be restricted. In addition, since the conductor in the hollow inner portion of the at least one support bar causes a short circuit to occur between opposing inside walls defining the cavity, the resonance frequencies of the TM modes in which the electric field vectors are oriented between the at least one inside wall defining the cavity become considerably higher than a frequency that is used, so that it is possible to circumvent the problem arising from the influences of the spurious modes.

By forming the cross section of the at least one support bar and the through hole of the dielectric core with a polygonal shape, the dielectric core is forced to rotate around the at least one support bar, so that variations in the characteristics can be restricted by the rotation of the dielectric core.

By forming the multiple-mode dielectric resonator as a triplex TE01 delta mode resonator, a small dielectric resonator device including three resonators in a common cavity can be provided.

According to the invention, by including any one of the above-described multiple-mode dielectric resonators and external coupling means externally coupled to a predetermined mode of the dielectric resonator, a small dielectric filter having low insertion loss can be used.

Further, according to the present invention, by providing any one of the multiple-mode dielectric resonators or the dielectric filter at a high-frequency circuit, a small communication device having low loss is provided.

REFERENCE NUMERALS

Figure 1:
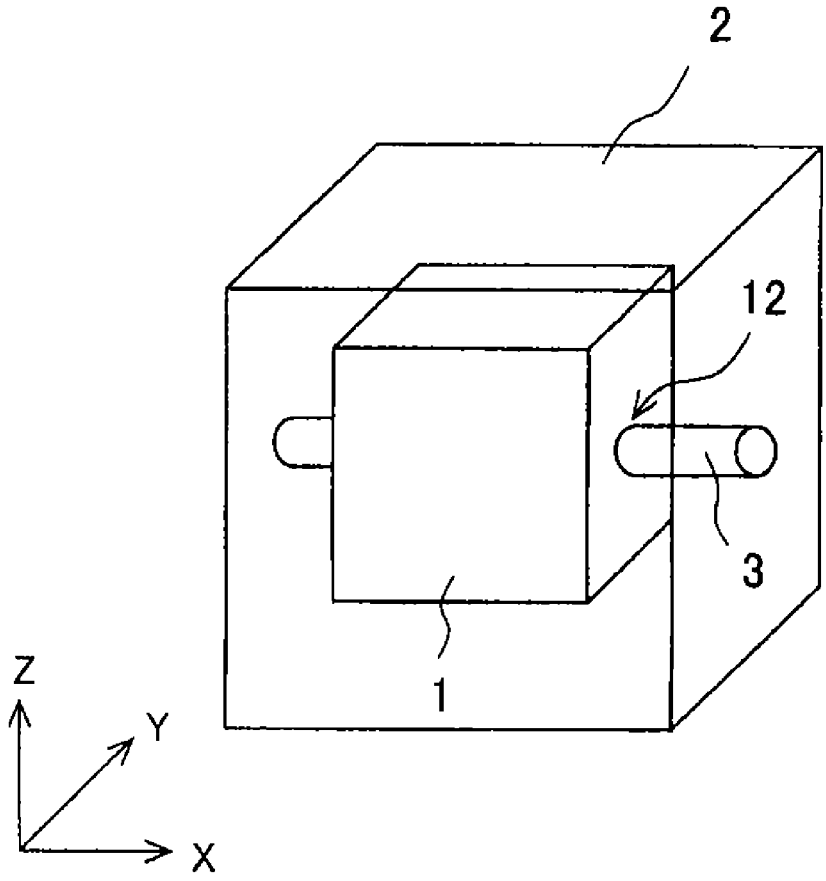
FIG. 1 is a perspective view of a structure of a multiple-mode dielectric resonator according to a first embodiment.
Figure 2:
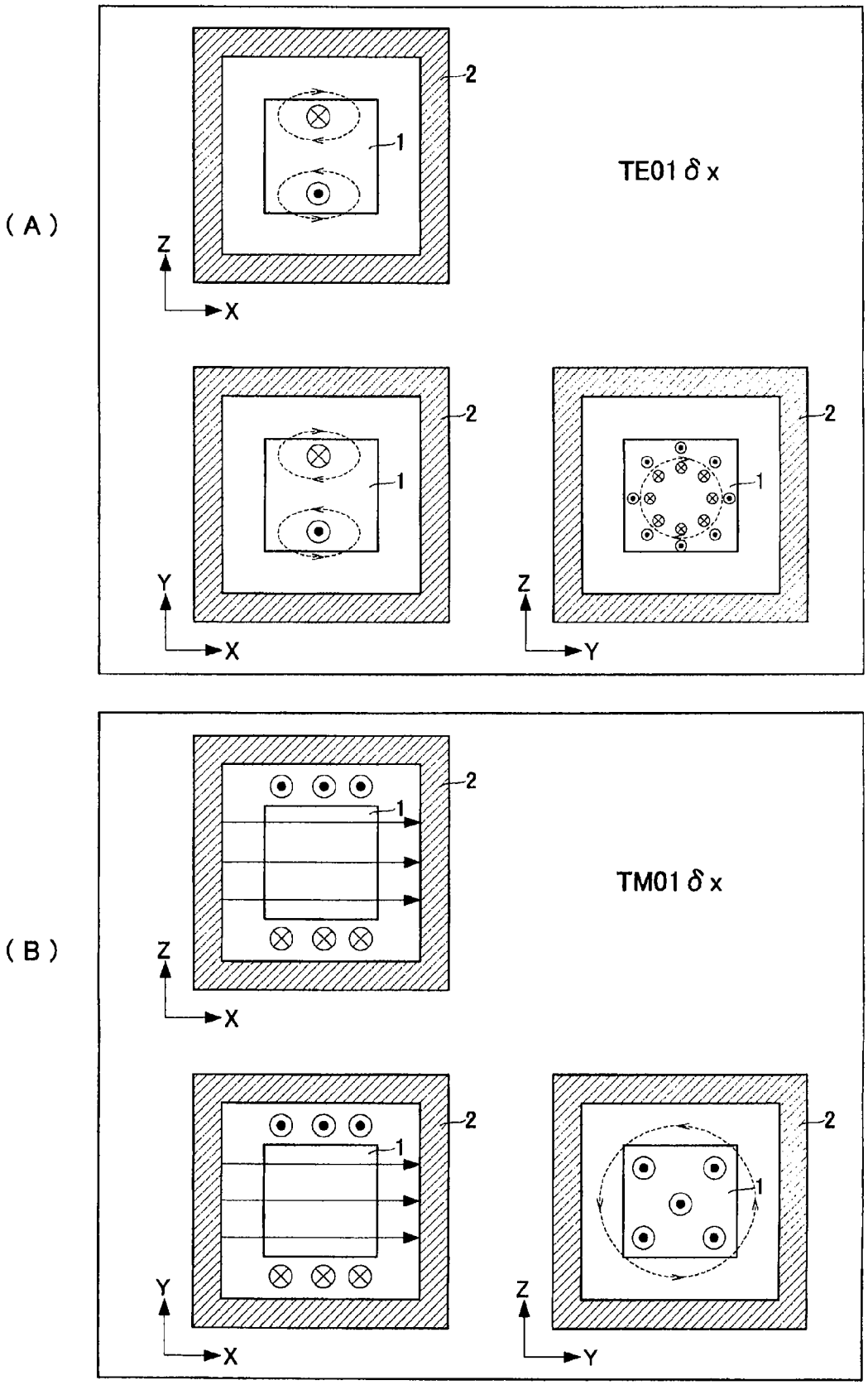
FIGS. 2(A) and 2(B) show, respectively, examples of electro-magnetic field distributions of a TE01 delta-x mode and a TM01 delta-x mode among a plurality of resonance modes that are set in the resonator.
Figure 3:
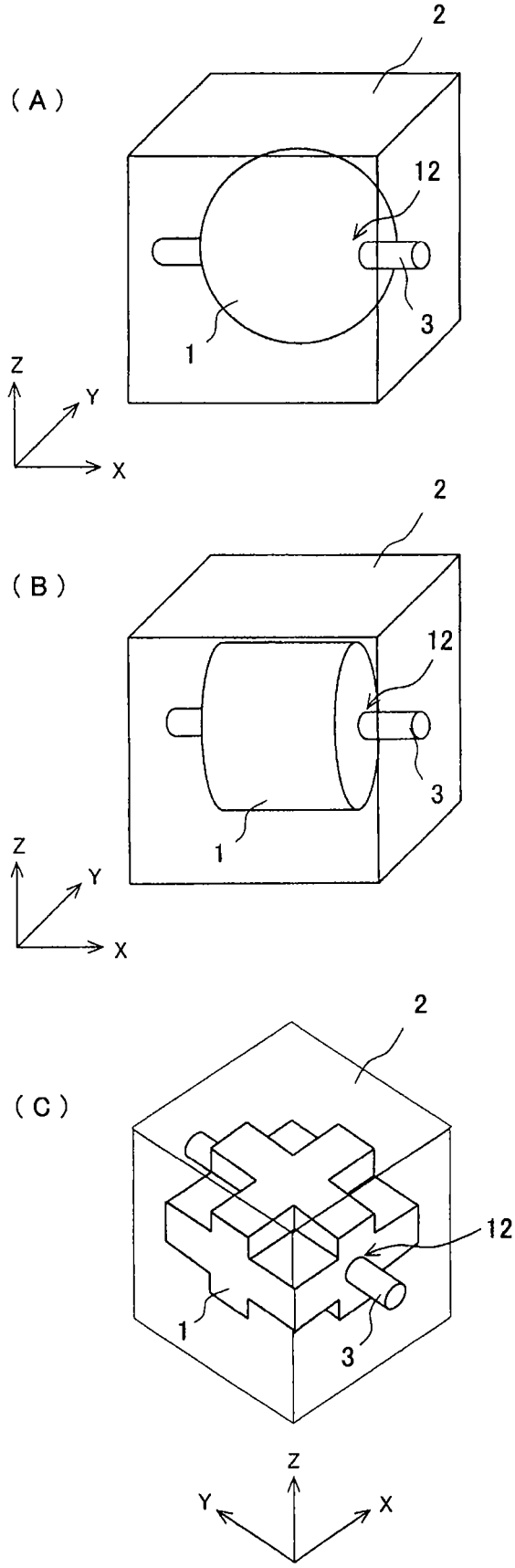
FIGS. 3(A) to 3(C) show structures of a multiple-mode dielectric resonator according to a second embodiment.

1 dielectric core
2 cavity
3 support bar
4 through hole
5 conductive bar
6 insulating bushing having low dielectric constant
7 threaded hole
8 recess
9, 10 groove
11, 12, 13 through hole
14 screw
15 hole
16 threaded hole
17 threaded portion
18 threaded hole
21, 22 coaxial connector
23, 24 coupling loop
25, 26 coupling loop conductor
27, 28 center conductor
29, 30 coupling window
40 support base

DETAILED DESCRIPTION OF THE INVENTION

A structure of a multiple-mode dielectric resonator according to a first embodiment of the invention will be described with reference to FIGS. 1 to 12.

FIG. 1 is a perspective view of a basic structure of the multiple-mode dielectric resonator. Here, a three-dimensional form formed by inner surfaces defining a cavity is shown by a frame. The multiple-mode dielectric resonator comprises a cavity 2, a dielectric core 1, and a support bar 3. The cavity 2 has a substantially rectangular parallelepiped form (hexahedral form). The dielectric core 1 has a substantially rectangular parallelepiped form, and is disposed in substantially the center of the cavity 2.

The dielectric core 1 has a through hole 12 passing through two opposing surfaces thereof, and the support bar 3 is inserted through and fitted to the through hole 12. The support bar 3 is conductive, and supports the dielectric core 1 in the cavity 2 as a result of adhering both ends of the support bar 3 to opposing inside walls defining the cavity 2.

FIGS. 2(A) and 2(B) show two resonance modes that are set in the multiple-mode dielectric resonator. Here, X, Y, and Z represent coordinate axes in three-dimensional directions shown in FIG. 1, and FIGS. 2(A) and 2(B) are each sectional views in two-dimensional planes. In the figures, a solid arrow represents an electric field vector, a broken arrow represents a magnetic field vector, and a dot or a cross represents a direction of the electric field or magnetic field.

FIG. 2(A) shows TE01 delta modes by a cylindrical coordinate system. In particular, in the example shown in FIG. 2(A), since the electric field vectors pass around a plane perpendicular to the X axis (that is, a plane parallel to a Y–Z plane), these will be represented as a TE01 delta-x mode. Since the dielectric core 1 has a cubic form, a TE01 delta-y mode in which electric field vectors pass around a plane perpendicular to the Y axis, and a TE01 delta-z mode in which electric field vectors pass around a plane perpendicular to the Z axis are similarly set.

FIG. 2(B) shows TM01 delta modes by a cylindrical coordinate system. In this mode, the electric field vectors are oriented between the opposing inside walls defining the cavity. In particular, in the example shown in FIG. 2(B), since the electric field vectors face the X-axis direction, these will be represented as a TM01 delta-x mode. Since the dielectric core 1 has a cubic form, a TM01 delta-y mode in which electric field vectors face the Y-axis direction, and a TM01 delta-z mode in which electric field vectors face the Z-axis direction are similarly set. Here, these three TM01 delta modes are spurious modes.

Exemplary forms of a multiple-mode dielectric resonator according to a second embodiment are shown in FIGS. 3(A) to 3(C). The exemplary forms of the multiple-mode dielectric resonator are illustrated in the same way that the multiple-mode dielectric resonator shown in FIG. 1 is illustrated, that is, the form of a cavity is shown by a frame indicating the three-dimensional form formed by the inside walls defining the cavity. In the embodiment shown in FIG. 1, the dielectric core 1 having a substantially cubic form is used, whereas in the exemplary form shown in FIG. 3(A), a substantially spherical dielectric core 1 is used. That is, a through hole 12 passing through substantially the center of the spherical dielectric core 1 is formed, and a support bar 3 is inserted through and fitted to the through hole 12. Both ends of the support bar 3 are secured to the cavity 2.

Even if the dielectric core 3 is substantially spherical, three TE01 delta modes that are perpendicular to each other are set.

In the exemplary form shown in FIG. 3(B), a cylindrical dielectric core 1 is used. That is, a through hole 12 is formed on a central axis parallel to a generating line at a side of the cylindrical surface of the cylindrical dielectric core 1, and a support bar 3 is inserted through and fitted to the through hole 12. Even if such a substantially cylindrical dielectric core 1 is used, the three TE01 delta modes that are perpendicular to each other can be used.

In the exemplary form shown in FIG. 3(C), a dielectric core 1 which is a block defined by a plane perpendicular to and parallel to an X-Y plane is used. Even if the dielectric core 1 has such a polygonal form, similarly, the three TE01 delta modes that are perpendicular to each other are set and can be used.

Figure 4:
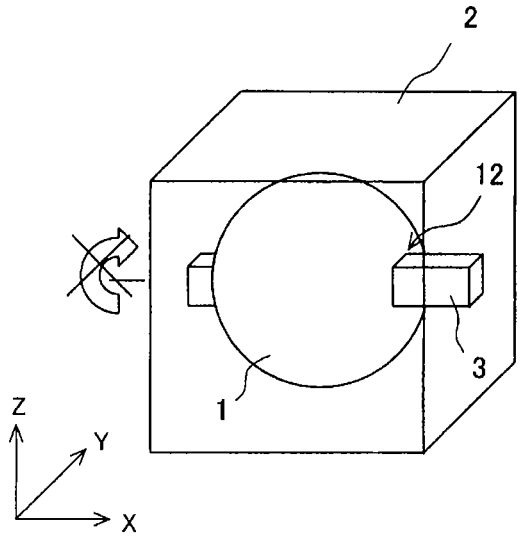
FIG. 4 shows a structure of a multiple-mode dielectric resonator according to a third embodiment.

Next, the multiple-mode dielectric resonator according to the third embodiment will be described on the basis of FIG. 4.

In the embodiment shown in FIG. 1 and the exemplary forms of the embodiment shown in FIGS. 3(A) to 3(C), the cross-sectional forms of the through holes 12, formed in the respective dielectric cores, and the cross-sectional forms of the support bars 3 are all spherical. In the embodiment shown in FIG. 4, the cross sectional forms of the through hole 12 in the dielectric core 1 and support bar 3 are rectangular, and the dimensions thereof are set so that the support bar 3 having a proper hardness can be fitted to the through hole 12 in the dielectric core 1.

By virtue of such a structure, the dielectric core 1 does not move in the axial direction of the support bar 3 or rotate around the axis of the support bar 3. Therefore, it is possible to increase the positional stability of the dielectric core 1 in the cavity 1. As a result, it is possible to stabilize electrical characteristics with respect to shock and vibration.

A multiple-mode dielectric resonator according to a fourth embodiment will be described with reference to FIGS. 5 and 6.

Figure 5:
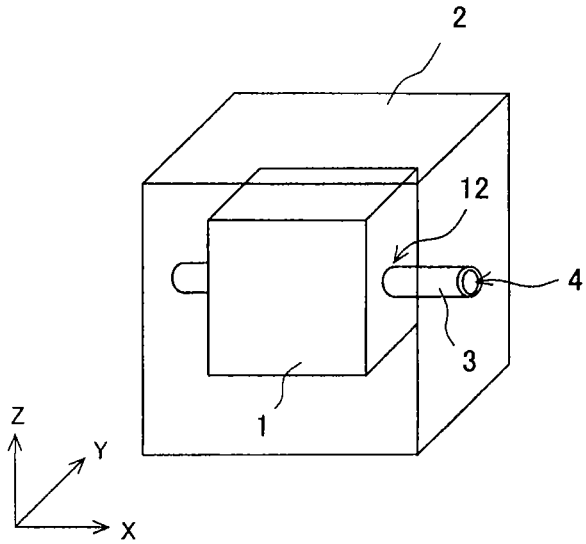
FIG. 5 shows a structure of a multiple-mode dielectric resonator according to a fourth embodiment.

In FIG. 5, a support bar 3 is formed of a dielectric material, and has a through hole 4 extending in an axial direction in a longitudinal direction thereof and having a conductive film formed in the inner surface defining the through hole 4. A dielectric core 1 is mechanically supported around the dielectric portion of the support bar 3, and the conductive film formed on the inner surface defining the through hole 4 causes a short circuit to occur between opposing inside walls defining a cavity.

Figure 16:
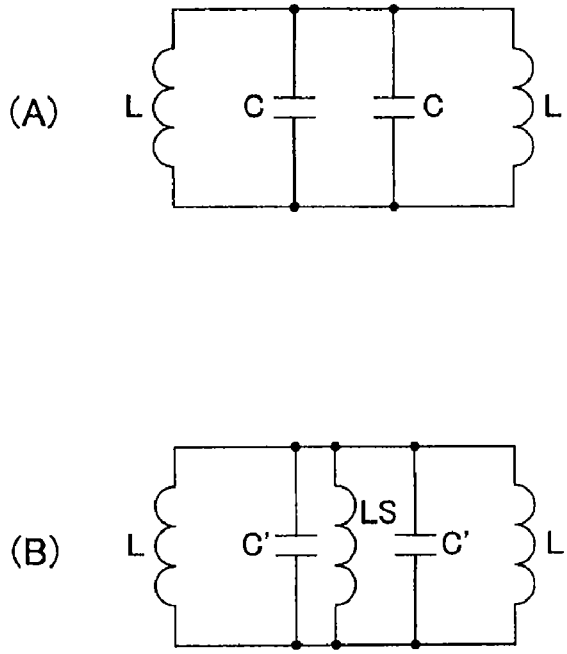
FIGS. 16(A) and 16(B) show equivalent circuits for a TM01 delta-x mode of the multiple-mode dielectric resonator shown in FIG. 1.
Figure 17:
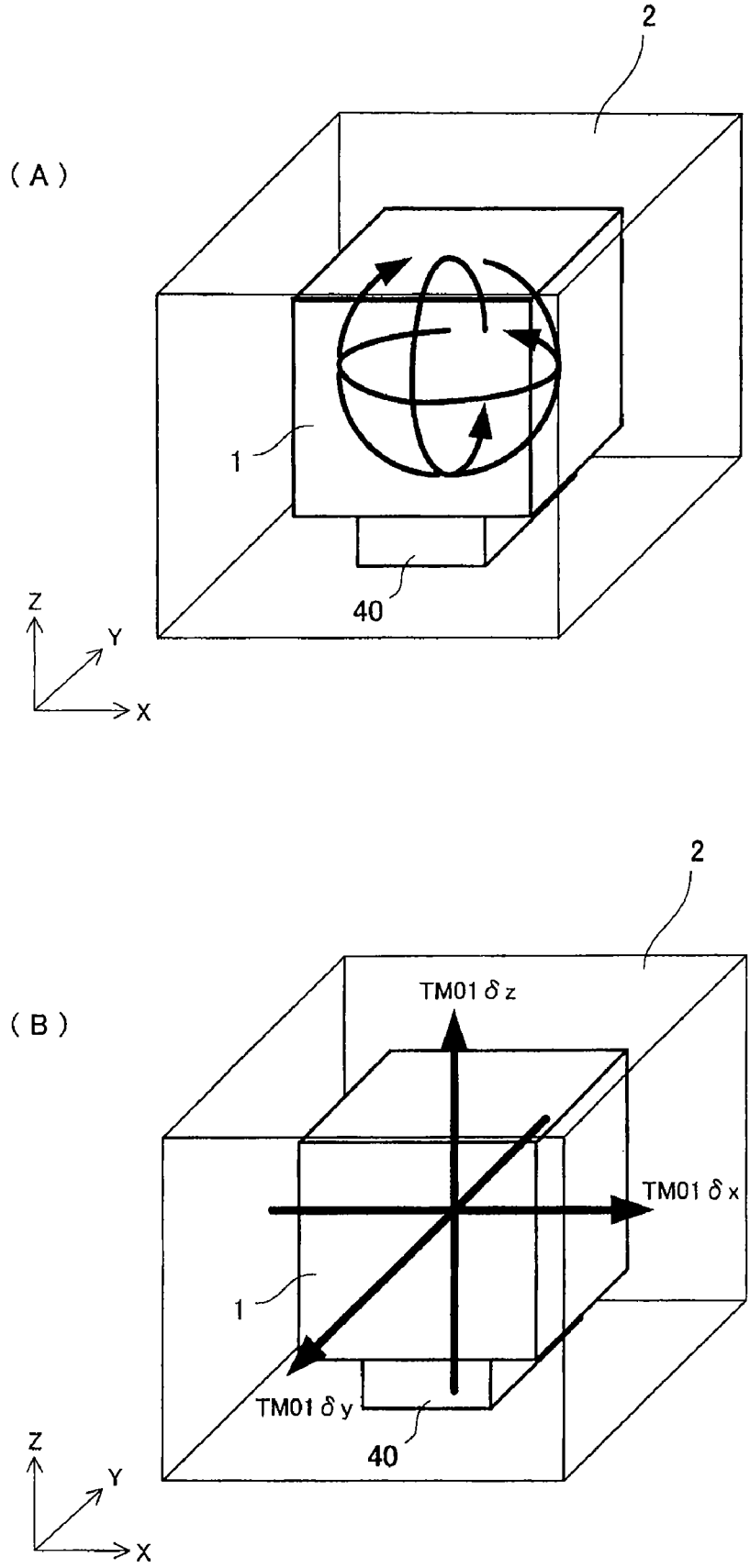
FIG. 17 PRIOR ART
FIGS. 17(A) and 17(B) show an example of a structure of a related multiple-mode dielectric resonator using a support base and resonance modes that are set in the dielectric resonator.

Equivalent circuits for a TM01 delta-x mode of the dielectric resonator in which the support bar 3 facing the X-axis direction causes a short circuit to occur between the opposing inside walls defining the cavity are shown in FIGS. 16(A) and 16(B). In a case in which there is no support bar 3, the equivalent circuit is as shown in FIG. 16(A). Here, each C represents a capacitance component between the opposing inside wall surfaces defining the cavity with the dielectric core 1 being disposed between the inside walls, and each L represents an inductance component, resulting from a conductor at the cavity 1, in terms of a lumped constant circuit. Such a parallel resonance circuit determines the resonance frequencies of the TM01 delta-x mode. When, as shown in FIG. 5, the support bar 3 passes through the dielectric core 1 and causes a short circuit to occur between the inside wall surfaces defining the cavity 2, then, as shown in FIG. 16(B), an inductor (inductance) LS is connected in parallel with capacitors (capacitances) C'. Here, LS represents the inductance component of the support bar 3. When such a support bar 3 is provided, the capacitances C shown in FIG. 16(A) are reduced to the capacitances C' that are slight amounts. Therefore, the resonance frequencies of the TM01 delta-x mode are considerably increased.

By virtue of the structure shown in FIG. 5, a conductor does not directly contact the dielectric core 1, so that Q of the resonator can be maintained at a high value.

Figure 6:
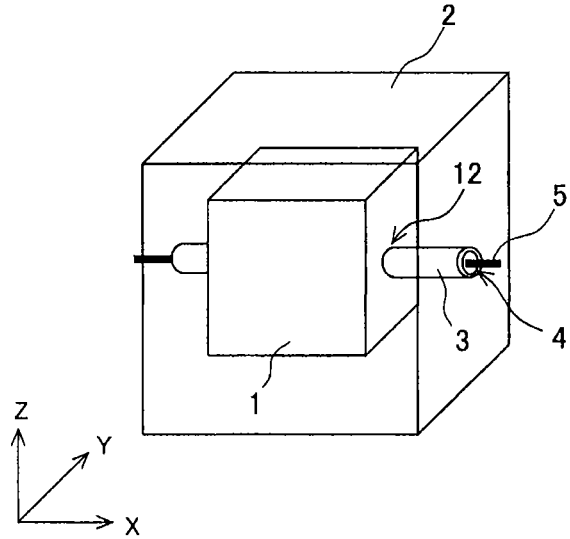
FIG. 6 shows another structure of the multiple-mode dielectric resonator according to the fourth embodiment.
Figure 7:
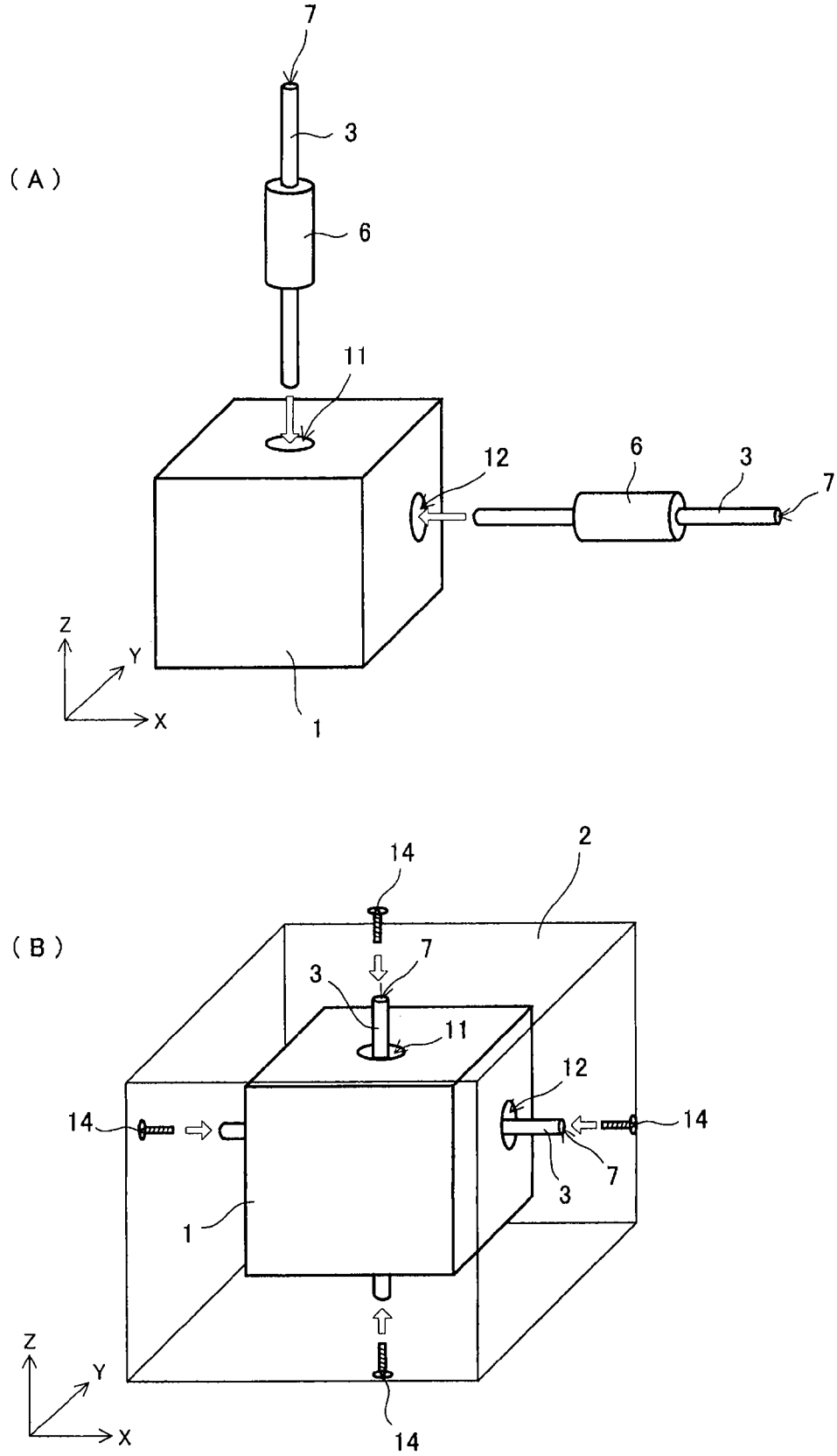
FIGS. 7(A) and 7(B) are perspective views of assembly structures of a multiple-mode dielectric resonator according to a fifth embodiment.
Figure 8:
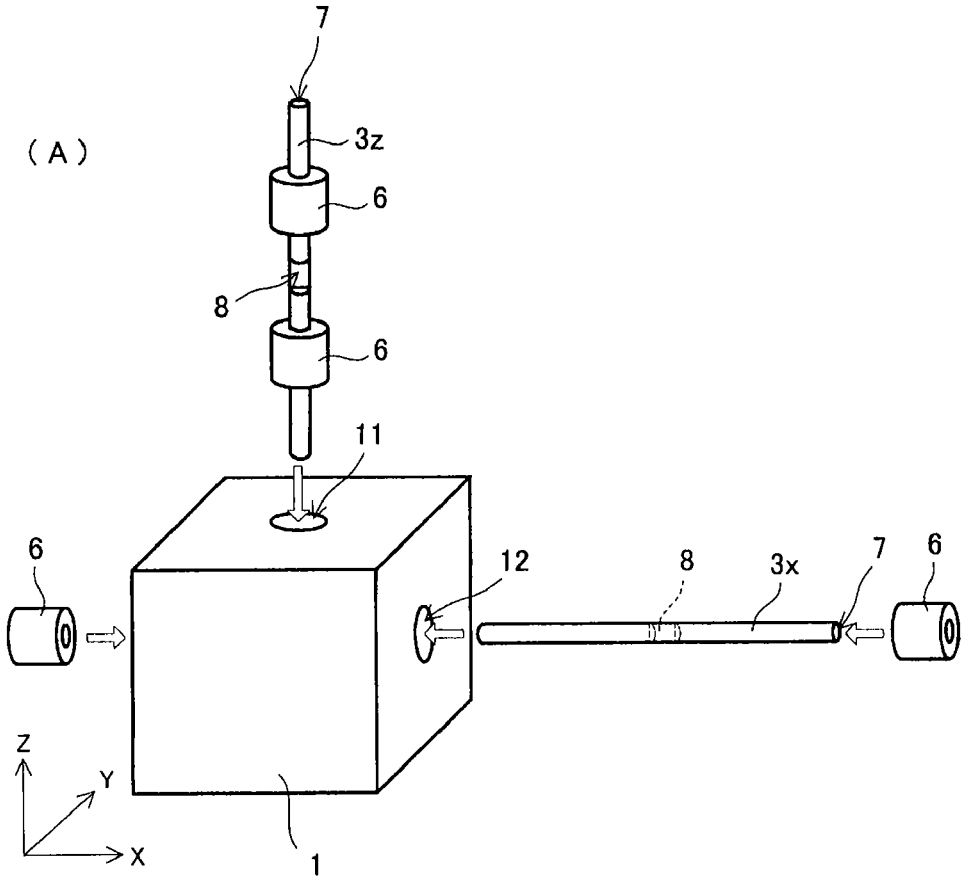
FIGS. 8(A) and 8(B) are, respectively, an exploded perspective view and a sectional view of a structure of a main portion of a multiple-mode dielectric resonator according to a sixth embodiment.
Figure 8:
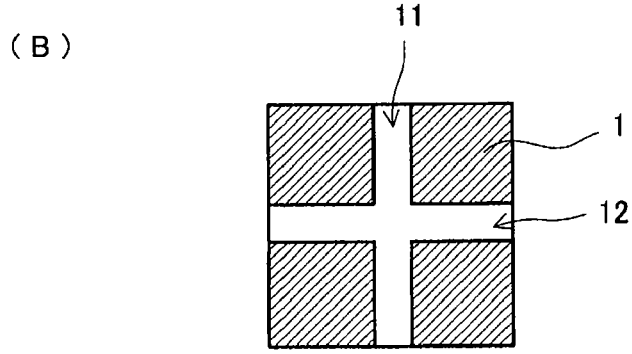

In the exemplary form shown in FIG. 6, as in the exemplary form shown in FIG. 5, a support bar 3 has a cylindrical form and a through hole 4. In addition, a conductive bar 5 formed of a metallic wire is inserted in the through hole 4. A dielectric core 1 is mechanically supported in a cavity 2 by the support bar 3, and both ends of the conductive bar 5 are electrically connected (short-circuited) to opposing inside walls defining the cavity 2. Even with such a structure, it is possible to maintain Q of the resonator at a high value because the dielectric core 1 does not directly contact a conductor. Using the cavity that is formed by using metal, and passing both ends of the conductive bar 5 into holes in the cavity 2 and soldering them to the respective walls defining the cavity 2 make it possible to facilitate electrical conduction.

A multiple-mode dielectric resonator according to a fifth embodiment will be described with reference to FIGS. 7(A) and 7(B).

FIG. 7(A) is an exploded perspective view showing the relationship between a dielectric core and support bars. FIG. 7(B) is a perspective view showing a structure of securing a unit comprising a dielectric core 1 and support bars 3 to a cavity 2.

In FIG. 7(A), the support bars 3 are metallic bars. Cylindrical low-dielectric-constant insulating bushings (hereunder simply referred to as "bushing") 6 formed of low-dielectric-constant insulating material, such as PTFE, are fitted around the central portions of the respective support bars 3. The support bars 3 having the respective bushings 6 fitted thereto are inserted in and fitted to respective through holes 11 and 12 formed in the dielectric core 1 (obviously, an adhesive is not used).

In this embodiment, the through hole 11 is formed in the dielectric core 1 so as to pass vertically therethrough in the figure, and the through hole 12 is formed in the dielectric core 1 so as to pass horizontally therethrough in the figure. The through holes 11 and 12 are positioned so as not to directly intersect each other in the dielectric core 1.

A threaded hole 7 is formed in each end of each support bar 3. As shown in FIG. 7(B), the unit comprising the dielectric core 1 and the conductive bars 3 is secured to the inner portions of the cavity 2 by screwing screws 14 into the threaded holes 7 from outside the cavity 2.

Accordingly, since the support bars 3, which are conductors, do not directly contact the dielectric core 1, Q of the resonator is not reduced. In addition, the dielectric core 1 is formed of dielectric ceramic and has a relative dielectric constant of approximately 80, whereas the bushings 6 are formed of PTFE and have a low dielectric constant of 2 to 3. Therefore, it is possible to prevent concentration of electric field energy near the support bars 3, and to increase the effect of restricting reduction of Q.

A multiple-mode dielectric resonator according to a sixth embodiment will be described with reference to FIGS. 8(A) and 8(B).

In the embodiment shown in FIGS. 7(A) and 7(B), the two through holes 11 and 12 intersect perpendicularly to each other two-dimensionally, as viewed from the Y axis, but do not intersect with each other with respect to the dielectric core 1 (that is, they intersect three-dimensionally). In contrast, in the embodiment shown in FIGS. 8(A) and 8(B), two through holes 11 and 12 intersect perpendicularly to each other in a dielectric core 1.

FIG. 8(A) is an exploded perspective view showing the relationship between, for example, the dielectric core and support bars, and FIG. 8(B) is a sectional view in a plane passing the through holes 11 and 12 in the dielectric core 1. Recesses 8 are formed in intersection portions of two support bars 3*x* and 3*z* so that the support bars 3*x* and 3*z* can intersect each other in the dielectric core 1, and the support bars 3*x* and 3*x* are disposed so that their recesses 8 contact each other. Two bushings 6 are fitted to each of the support bars 3*x* and 3*z* so that the bushings 6 of the support bar 3*x* and the bushings 6 of the support bar 3*z* do not interfere with each other.

When assembling a unit comprising the dielectric core 1, the support bars 3*z* and 3*x*, and the bushings 6, first, the two bushings 6 and 6 are fitted to the support bar 3*z*, and the support bar 3*z* to which the bushings 6 have been fitted is press-fitted to the through hole 11 of the dielectric core 1. Next, the support bar 3*x* is inserted into the through hole 12 of the dielectric core 1, and the bushings 6 are press-fitted to both ends of the support bar 3*x*, that is, both ends of the through hole 12. Here, the recesses 8 of the two support bars 3 are superimposed upon each other so that the two support bars 3 intersect each other. Thereafter, as in the case shown in FIG. 7(B), the unit comprising the dielectric core 1, the support bars 3*z* and 3*x*, and the bushings 6 is inserted into a cavity 2 and is secured to the inner portion of the cavity from outside the cavity by screwing.

In the embodiment shown in FIGS. 8(A) and 8(B), since the dielectric core 1 is supported in the cavity by the two support bars 3*z* and 3*x* that pass through the center of the dielectric core 1 and that are perpendicularly intersect each other, that is, since the two support bars 3 both pass through the center of gravity of the dielectric core 1, it is possible to minimize the influences of a rotation moment around the center-of-gravity axis of the dielectric core 1 on the support bars 3*x* and 3*z*, so that the dielectric core 1 can be more firmly supported in the cavity. As a result, it is possible to reduce variations in the characteristics with respect to vibration and shock.

Figure 9:
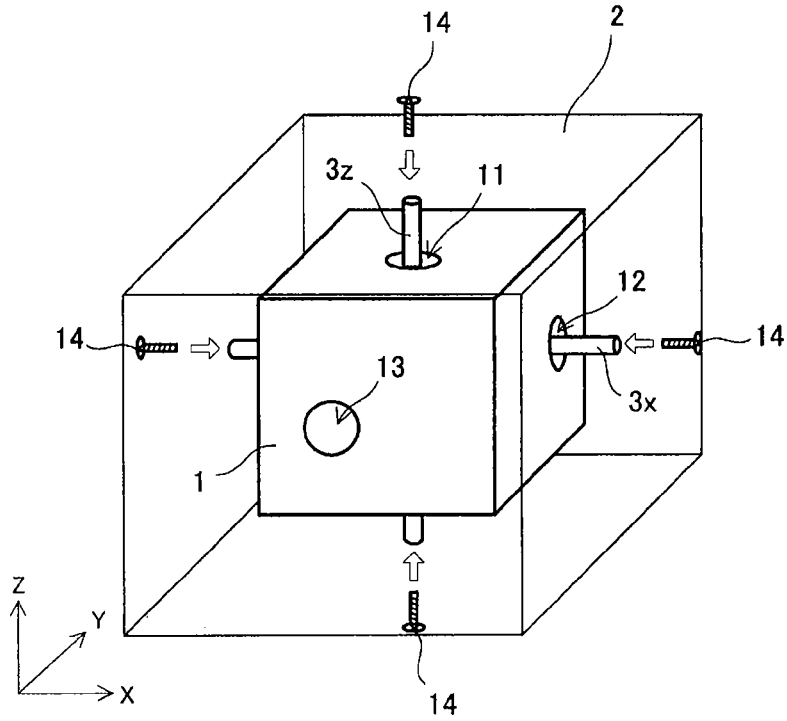
FIG. 9 is a perspective view of an assembly structure of a multiple-mode dielectric resonator according to a seventh embodiment.

FIG. 9 is a perspective view of a structure of a multiple-mode dielectric resonator according to a seventh embodiment. In this embodiment, through holes 12, 13, and 11 are formed in respective three axial directions, an X-axis direction, a Y-axis direction, and a Z-axis direction, of a dielectric core 1. Support bars 3*z* and 3*x* are inserted into the through holes 11 and 12 among the through holes, respectively. Since the dielectric core has a symmetrical form in the X, Y, and Z axis directions as a result of forming the through holes in the respective three axial directions, even if the dielectric core 1 has a simple cubic form, it is possible to make the same the resonance frequencies of a TE01 delta-x mode in which electric field vectors pass around a plane perpendicular to the X axis and the resonance frequencies of a TE01 delta-z mode in which electric field vectors pass around a plane perpendicular to the Z axis.

Figure 10:
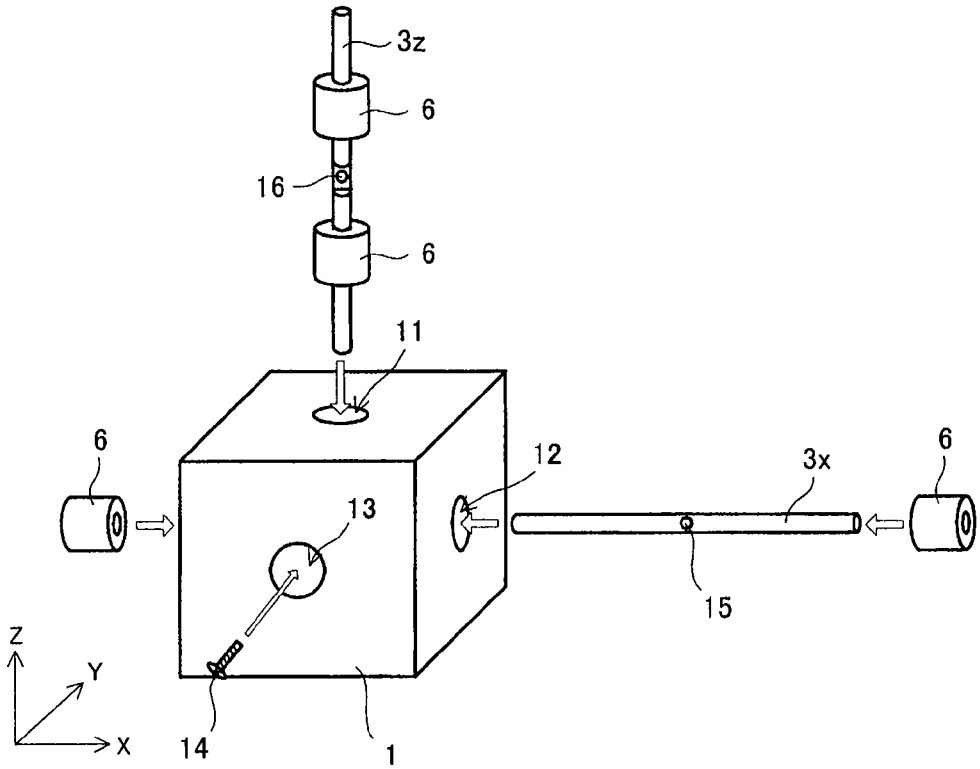
FIG. 10 is an exploded perspective view of a structure of a main portion of a multiple-mode dielectric resonator according to an eighth embodiment.
Figure 11:
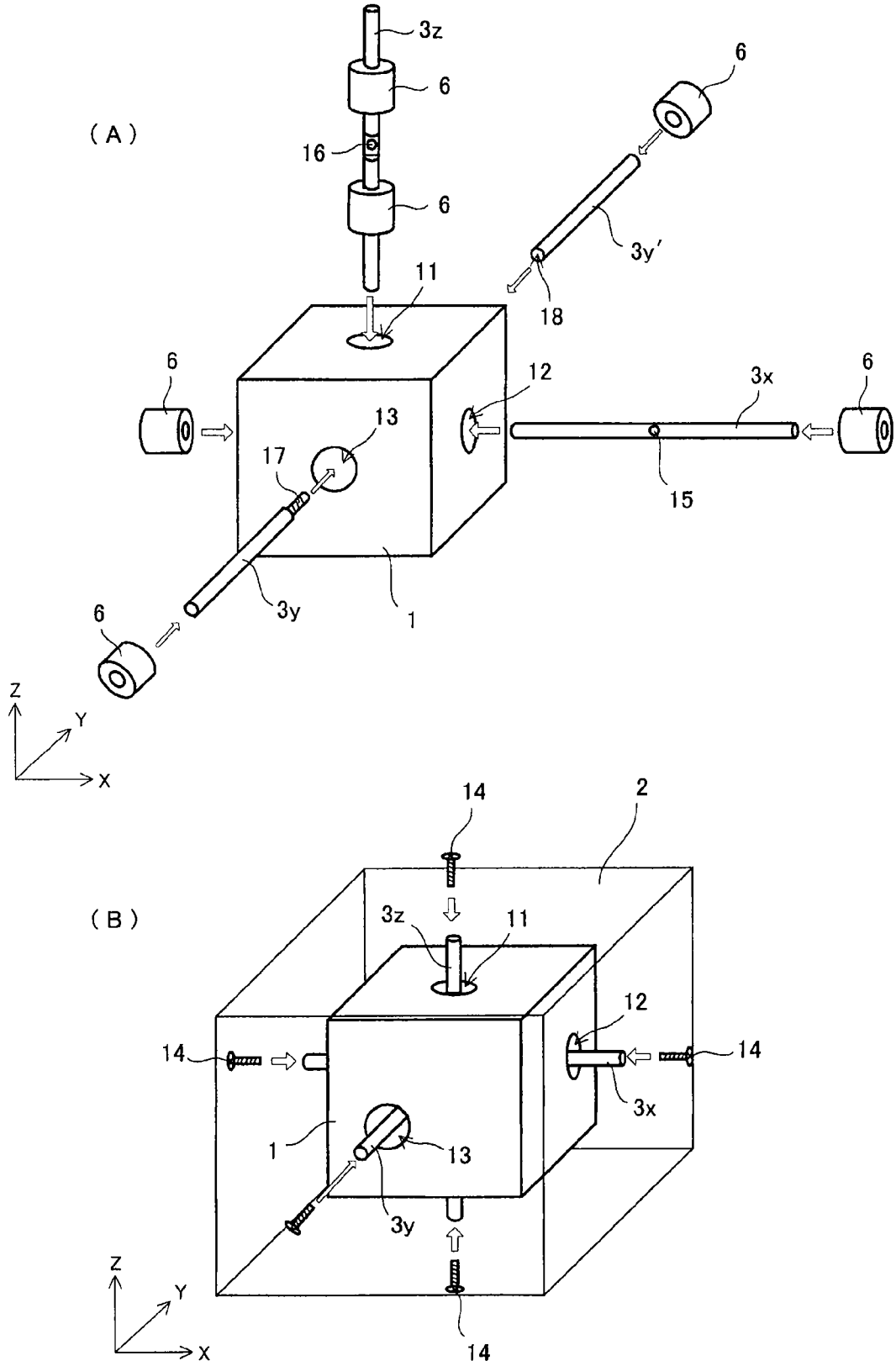
FIGS. 11(A) and 11(B) are exploded perspective views of an assembly structure and a structure of a main portion of a multiple-mode dielectric resonator according to a ninth embodiment.

FIG. 10 is an exploded perspective view of a structure of a main portion of a multiple-mode dielectric resonator according to an eighth embodiment. In this embodiment, through holes 12, 13, and 11 passing through the center of a dielectric core 1 in an X axis direction, a Y axis direction, and a Z axis direction are formed in the dielectric core 1, and two support bars 3*z* and 3*x* perpendicularly intersect each other in the dielectric core 1. Unlike the structure shown in FIGS. 8(A) and 8(B), in the structure shown in FIG. 10, a through hole 13 that perpendicularly intersects both the through holes 11 and 12 into which the respective support bars 3*z* and 3*x* are inserted is formed. In addition, a hole 15 is formed in the support bar 3*x* that is inserted into the through hole 12, and a threaded hole 16 is formed in the center of the support bar 3*z* that is inserted into the through hole 11. A screw 14 is inserted into the threaded hole 15 from the through hole 13 to screw the two support bars 3*z* and 3*x* together.

By virtue of such a structure, the two support bars 3*z* and 3*x* are screwed and connected to each other, so that the positional precision of the dielectric core 1 with respect to both ends of each of the two support bars 3*z* and 3*x* is increased, and the rigidity of the support bars 3*z* and 3*x* is increased. Therefore, positional variations of the dielectric core 1 in the cavity with respect to vibration and shock can be further reduced, so that stabilized characteristics can be obtained.

FIGS. 11(A) and 11(B) show a structure of a multiple-mode dielectric resonator according to a ninth embodiment. In this embodiment, through holes 12, 13, and 11 are formed in a dielectric block 1 in three axial directions, an X axis direction, a Y axis direction, and a Z axis direction, and support bars 3*x*, 3*y*, 3*y*', and 3*z* are inserted into these through holes. In this structure, the support bars 3*y* and 3*y*' are provided instead of the screw 14 that screws the two support bars 3*z* and 3*x* shown in FIG. 10 together. That is, the support bars 3*y* and 3*y*' that are substantially equally divided members are used, and a threaded portion 17 is provided at an end of the support bar 3*y* and a threaded hole 18 is provided at an end of the support bar 3*y*'. An assembling operation is performed such that, in the dielectric core 1, the threaded portion 17 is passed through a hole 15 in the center of the support bar 3*x* and the threaded portion 17 is screwed to a threaded hole 16 in the center of the support bar 3*z*. Bushings 6 are fitted to each of the support bars 3*x*, 3*y*, 3*y*', and 3*z*.

FIG. 11(B) shows a structure of securing a unit, formed by assembling each member shown in FIG. 11(A), to inner portions of a cavity 2. Threaded holes are formed in ends of the support bars 3*x*, 3*y*, (3*y*'), and 3*z*. By screwing screws 14 into the threaded holes from outside the cavity 2, the unit including the dielectric core 1, the support bars 3, and the bushings 6 is secured at the central portion in the cavity 2.

Figure 12:
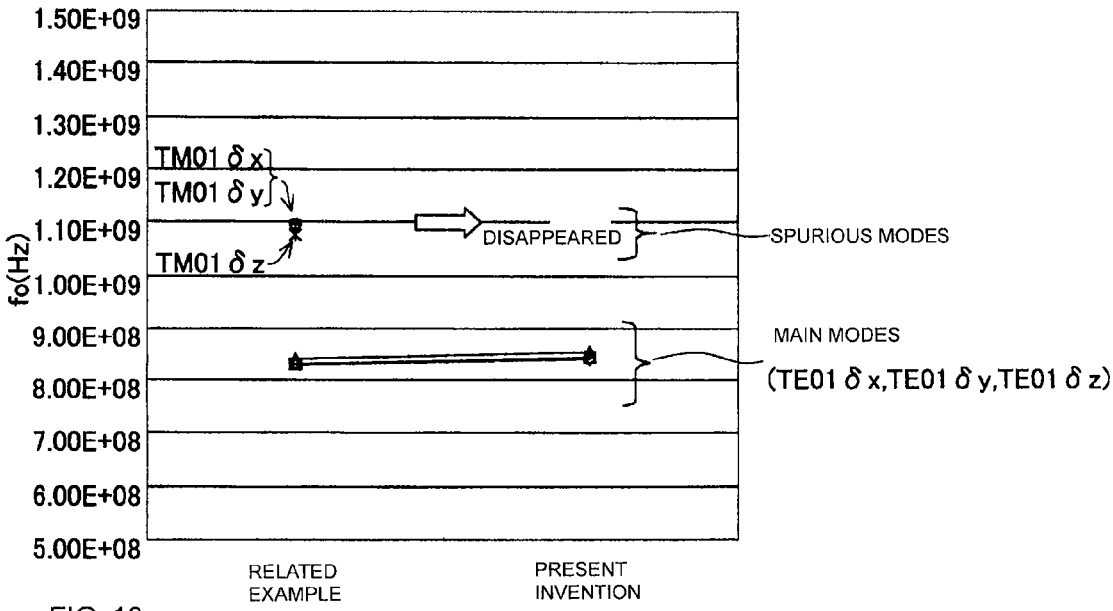
FIG. 12 shows the relationship between frequencies of respective resonance modes in the resonator and frequencies of respective resonance modes in a related resonator including a support base.

FIG. 12 shows resonance frequencies of a plurality of resonance modes that are set in this multiple-mode dielectric resonator. In a related dielectric resonator of a type in which a dielectric core is supported by a support base, when the resonance frequencies of three modes, a TE01 delta-x mode, a TE01 delta-y mode, and a TE01 delta-z mode, are approximately 830 MHz, three spurious modes, a TM01 delta-x mode, a TM01 delta-y mode, and a TM01 delta-z mode, where resonance occurs at approximately 1.1 GHz, are set. In contrast, as shown in FIGS. 11(A) and 11(B), when the dielectric core 1 is supported by the support bars 3*x*, 3*y*, 3*y*', and 3*z*, and the conductive support bars 3*x*, 3*y*, 3*y*', and 3*z* cause a short circuit to occur between opposing inside walls defining the cavity 2, the resonance frequencies of the three TE01 delta modes that are used substantially do not change. Accordingly, the frequencies of the aforementioned three TM01 delta modes, which are spurious modes, are much higher than the resonance frequencies of the three TE01 delta modes. Since the frequencies of the three TM01 delta modes do not fall within the frequency range shown in FIG. 12, this state is shown as "disappeared" in FIG. 12.

Accordingly, since the resonance frequencies of the TM01 delta-x mode, the TM01 delta-y mode, and the TM01 delta-z mode, which are spurious modes, are considerably separated from the resonance frequencies of the TE01 delta-x mode, the TE01 delta-y mode, and the TE01 delta-z mode, which are used, it is possible to circumvent the problem arising from the influences of the three spurious modes, the TM01 delta-x mode, the TM01 delta-y mode, and the TM01 delta-z mode.

Figure 13:
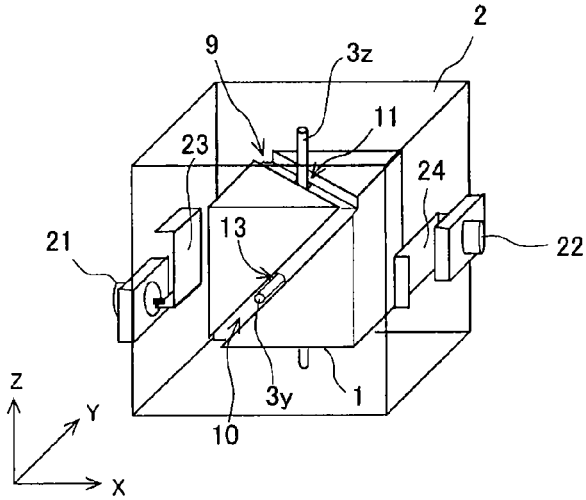
FIG. 13 shows a structure of a dielectric filter according to a tenth embodiment.

A dielectric filter according to a tenth embodiment will be described with reference to FIG. 13. FIG. 13 is a perspective view of the dielectric filter. To show only the three-dimensional form formed by inner surfaces defining a cavity 2, the cavity 2 is shown in the form of a frame. A securing structure of a dielectric core 1 in the cavity 2 is similar to those in the already discussed embodiments. In this embodiment, a through hole 11 passing through the dielectric core 1 in a Z axis direction thereof is formed, a support bar 3*z* having a low-dielectric-constant insulating bushing fitted thereto is inserted into the through hole 11, and both ends of the support bar 3*z* are joined to walls of the cavity 2. Similarly, a through hole 13 passing through the dielectric core 1 in a Y axis direction is formed, a support bar 3*y* having a low-dielectric-constant insulating bushing fitted thereto is inserted into the through hole 13, and both ends of the support bar 3*y* are joined to walls of the cavity 2.

Coaxial connectors 21 and 22 are provided at outer surfaces (outer portions) of the cavity 2. Although the cavity 2 actually has a thickness, this thickness is not provided in the figure. One end of a coupling loop 23 is connected to a center conductor of the coaxial connector 21, one end of a coupling loop 24 is connected to a center conductor of the coaxial connector 22, and the other ends of the coupling loops 23 and 24 are connected to inner surfaces defining the cavity 2. Since a loop surface of the coupling loop 23 faces an X−Z surface, a magnetic field facing the Y axis direction is linked at this loop surface. In other words, the coupling loop 23 is magnetically coupled to a TE01 delta-y mode. In addition, since a loop surface of the coupling loop 24 faces an X-Y plane, a magnetic field facing the Z axis direction is linked at this loop surface. In other words, the coupling loop 24 is magnetically coupled to a TE01 delta-z mode.

A groove 9 having a predetermined depth and extending in a (Y−X) axial direction and a groove 10 having a predetermined depth and extending in a (X+Z) axial direction are formed in the dielectric core 1. The groove 9 causes a difference to be produced between frequencies of an even mode and an odd mode, which are coupled modes of the TE01 delta-x mode and the TE01 delta-y mode. (In the TE01 delta-x mode, electric field vectors pass around a plane perpendicular to the X axis direction. In the TE01 delta-y mode, electric field vectors pass around a plane perpendicular to the Y axis direction.) Therefore, the groove 9 causes coupling of the TE01 delta-x mode and the TE01 delta-y mode. Similarly, the groove 10 causes a difference to be produced between frequencies of an even mode and an odd mode, which are coupled modes of the TE01 delta-x mode and the TE01 delta-z mode. (In the TE01 delta-x mode, electric field vectors pass around a plane perpendicular to the X axis direction. In the TE01 delta-z mode, electric field vectors pass around a plane perpendicular to the Z axis direction.) Therefore, the groove 10 causes coupling of the TE01 delta-x mode and the TE01 delta-z mode.

As a result, coupling occurs in the following order: the coupling loop 23→TE01 delta-y mode→TE01 delta-x mode→TE01 delta-z mode→coupling loop 24. Accordingly, this dielectric filter operates as a filter having a bandpass characteristic and including three resonators between the coaxial connectors 21 and 22.

A filter according to an eleventh embodiment will be described on the basis of FIG. 14.

Figure 14:
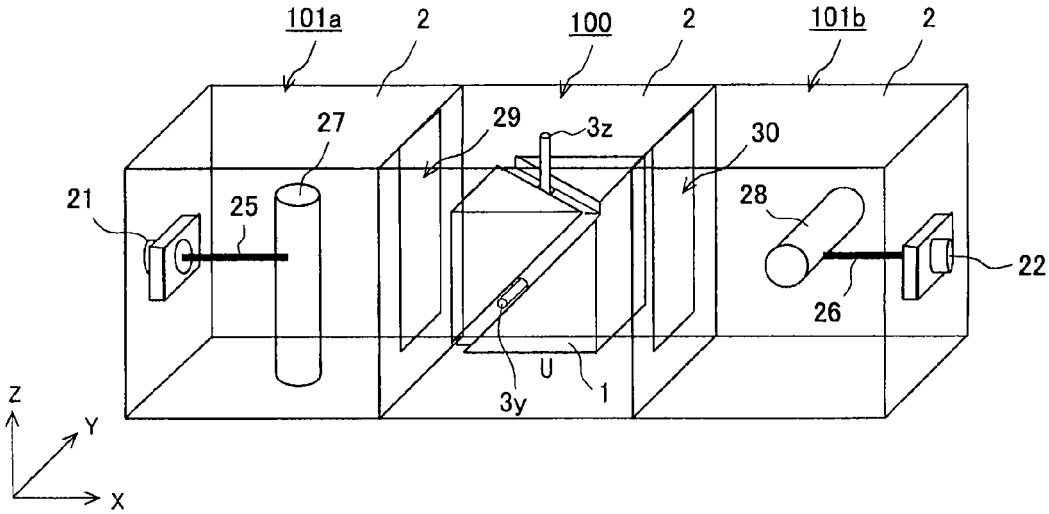
FIG. 14 shows a structure of a dielectric filter according to an eleventh embodiment.

FIG. 14 is a perspective view of the filter. This filter includes filter units 101*a*, 100, and 101*b*. The filter unit 101*a* constitutes a semi-coaxial resonator as a result of providing a center conductor 27 facing a Z-axis direction in a cavity 2. A coupling loop conductor 25 extending from the center conductor at a coaxial connector 21 and connected to a predetermined location of the center conductor 27 is provided at the center conductor 27. A base of the center conductor 27 and coupling loop conductor 25 form a coupling loop. The filter unit 101*b* constitutes a semi-coaxial resonator as a result of providing a center conductor 28 facing a Y-axis direction in the cavity 2. A coupling loop conductor 26 extending from the center conductor at a coaxial connector 22 and connected to a predetermined location of the center conductor 28 is provided at the center conductor 28. A base of the center conductor 28 and coupling loop conductor 26 form a coupling loop. The structure of the filter unit 100 is basically the same as that shown in FIG. 13. The difference is that coupling windows 29 and 30 are provided instead of the coupling loops 23 and 24 shown in FIG. 13. Support bars 3*y* and 3*z* are fitted to through holes formed in a dielectric core 1, and both ends of each support bar are secured to wall surfaces defining the cavity 2.

A mode of the semi-coaxial resonator for the filter unit 101*a* is magnetically coupled to a TE01 delta-y mode of the filter unit 100. A mode of the semi-coaxial resonator for the filter unit 101*b* is magnetically coupled to a TE01 delta-z mode of the filter unit 100. Therefore, the entire filter operates as a filter exhibiting a bandpass characteristic, in which five resonators (1+3+1=5) are sequentially coupled.

Accordingly, the first and the last resonators are formed as semi-coaxial resonators, and a strong external coupling is achieved by the coupling loops. Therefore, a wide bandwidth characteristic can be easily obtained.

A structure of a communication device according to a twelfth embodiment will be described on the basis of FIG. 15.

Figure 15:
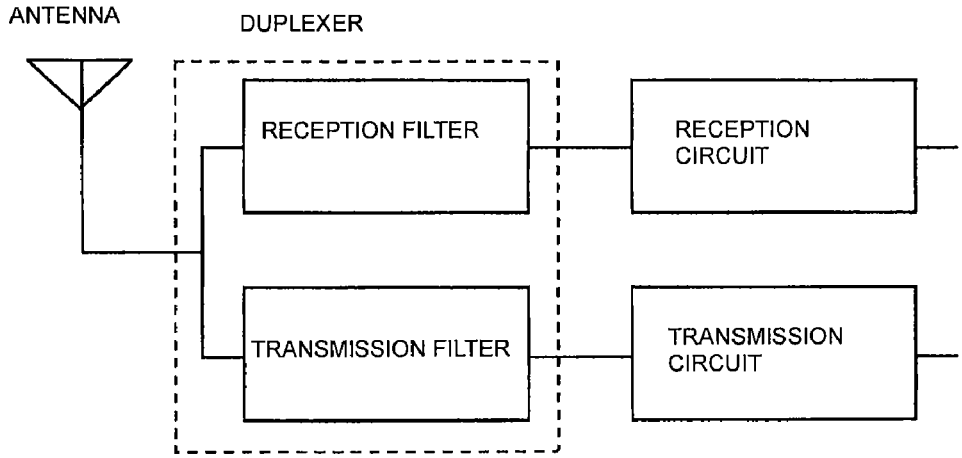
FIG. 15 is a block diagram of a structure of a communication device according to a twelfth embodiment.

FIG. 15 is a block diagram of the structure of the communication device and a duplexer including the aforementioned filters. A transmission filter and a reception filter constitute the duplexer formed as an antenna sharing device. A transmission circuit is connected to a transmission signal input port of the duplexer and a reception circuit is connected to a reception signal output port. By connecting an antenna to the input port and the output port of the duplexer, a high-frequency of the communication device is formed.

Accordingly, it is possible to form a small duplexer as a result of including many resonators and small filters. In addition, it is possible to form a small, light communication device including a small duplexer.

The invention claimed is:

1. A multiple-mode dielectric resonator comprising:

a conductive cavity having a rectangular parallelepiped form;

a dielectric core disposed in the conductive cavity so as to be separated by a predetermined distance from a surface of at least one inside wall defining the cavity; and at least two support bars inserted into respective through holes in the dielectric core, the at least two support bars being secured to the cavity so that the dielectric core is supported in the cavity, and both ends of each support bar are joined to different pairs of opposing inside walls of the cavity.

2. The multiple-mode dielectric resonator according to claim 1, wherein the dielectric core has a substantially rectangular parallelepiped form.

3. The multiple-mode dielectric resonator according to claim 1, wherein at least a portion of the at least two support bars are formed of a dielectric material whose dielectric constant is lower than that of the dielectric core.

4. The multiple-mode dielectric resonator according to claim 1, wherein the respective through holes and the at least two support bars each have a polygonal form in cross section.

5. A communication device comprising:

a high frequency circuit including the multiple-mode dielectric resonator of claim 1.

6. The multiple-mode dielectric resonator according to claim 1, wherein excitation occurs at three TE01 delta modes in which electric field vectors pass around an X axis, a Y axis, and a Z axis, where the X, Y, and Z axes are coordinate axes that are orthogonal to each other.

7. The multiple-mode dielectric resonator according to claim 1, wherein the cavity has a rectangular parallelepiped form, the dielectric resonator includes at least three support bars, and both ends of each support bar are joined to different pairs of opposing inside walls of the cavity.

8. The multiple-mode dielectric resonator according to claim 1, wherein the dielectric core is substantially spherical.

9. The multiple-mode dielectric resonator according to claim 1, wherein the dielectric core is cylindrical.

10. The multiple-mode dielectric resonator according to claim 1, wherein the dielectric core is in the form of a block having respective surfaces defined by a plane perpendicular and parallel to an X-Y plane.

11. A dielectric filter comprising:

the multiple-mode dielectric resonator of claim 1; and an external coupling externally coupling to a predetermined mode of the multiple-mode dielectric resonator.

12. A communication device comprising:

a high frequency circuit including the dielectric filter of claim 11.

13. The multiple-mode dielectric resonator according to claim 1, wherein the at least two support bars are conductive, and both ends of each of the at least two support bars are electrically connected to opposing inside walls of the cavity so that a short circuit is produced between the opposing inside walls.

14. The multiple-mode dielectric resonator according to claim 13, wherein an insulating bushing is disposed between an inner surface of each through hole and its respective support bar.

15. The multiple-mode dielectric resonator according to claim 14, wherein the bushing is formed of a material whose dielectric constant is lower than that of the dielectric core.

16. The multiple-mode dielectric resonator according to claim 1, wherein the at least two support bars are hollow and are formed of a material whose dielectric constant is lower than that of the dielectric core, and a conductor is disposed in the hollow support bar.

17. The multiple-mode dielectric resonator according to claim 16, wherein the conductor is a conductive film formed on an inside surface of the hollow support bar.

18. The multiple-mode dielectric resonator according to claim 16, wherein the conductor is a conductive bar inserted into the hollow support bar.

* * * * *